US009756696B1

(12) United States Patent
Bradford

(10) Patent No.: US 9,756,696 B1
(45) Date of Patent: Sep. 5, 2017

(54) CONFIGURABLE LED LIGHTING APPARATUS

(71) Applicant: Cree, Inc., Durham, NC (US)

(72) Inventor: Everett Bradford, Apex, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 15/294,992

(22) Filed: Oct. 17, 2016

(51) Int. Cl.
*H05B 37/02* (2006.01)
*H05B 33/08* (2006.01)

(52) U.S. Cl.
CPC ..... *H05B 33/0866* (2013.01); *H05B 33/0845* (2013.01); *H05B 33/0884* (2013.01); *H05B 37/0227* (2013.01)

(58) Field of Classification Search
CPC H05B 37/02; H05B 37/0218; H05B 37/0227; H05B 37/0272; H05B 33/08; H05B 33/0845; H05B 33/0866; H05B 33/0884
USPC ..... 315/185 R, 192, 209 R, 291, 307, 308, 315/312
See application file for complete search history.

(56) References Cited

U.S. PATENT DOCUMENTS 7,213,940 B1 5/2007 Van De Ven et al.
7,614,759 B2 11/2009 Negley
8,598,809 B2 12/2013 Negley et al.
8,698,388 B2 4/2014 Cash
8,729,589 B2 * 5/2014 Hussell ..... H05B 37/02 257/433
8,950,892 B2 2/2015 Cash
9,052,067 B2 6/2015 van de Ven et al.
9,131,571 B2 9/2015 Zhang et al.
9,303,823 B2 4/2016 Hu et al.
2011/0068702 A1 * 3/2011 van de Ven ..... H05B 33/0854 315/186
2012/0306375 A1 12/2012 van de Ven
2013/0328073 A1 12/2013 Lowes et al.
2014/0197750 A1 7/2014 Cash
2014/0210364 A1 7/2014 Cash et al.
2014/0252967 A1 9/2014 van de Ven et al.
2015/0189708 A1 7/2015 Cash
2015/0312983 A1 10/2015 Hu et al.
2015/0330581 A1 11/2015 van de Ven et al.
2015/0351187 A1 12/2015 McBryde et al.

OTHER PUBLICATIONS

U.S. Appl. No. 15/018,375, filed Feb. 8, 2016.

* cited by examiner

*Primary Examiner* — Jimmy Vu
(74) *Attorney, Agent, or Firm* — Dennis J. Williamson; Moore & Van Allen PLLC

(57) ABSTRACT

A configurable LED lighting system and its method of operation are disclosed. A lighting system or apparatus includes a string of LEDs, wherein specific LEDs are operable to emit different colors of light. The string includes a plurality of series-connected color segments. A shunt segment includes additional LEDs. The LED shunt segment is connected in parallel with at least one of the color segments. A controller is connected to the LED shunt segment to selectively balance drive current between the LED shunt segment and the color segment to which it is connected in parallel so that a color temperature of light is controllable by a processor. The diverted power still produces light and power is not wasted. The controller can use a polynomial equation or a look-up table to calculate color output values.

34 Claims, 5 Drawing Sheets

CONFIGURABLE LED LIGHTING APPARATUS

BACKGROUND

Light emitting diode (LED) lighting systems are becoming more prevalent as replacements for existing lighting systems. LEDs are an example of solid state lighting and have advantages over traditional lighting solutions such as incandescent and fluorescent lighting because they use less energy, are more durable, operate longer, can be combined in multi-color arrays that can be controlled to deliver virtually any color light, and contain no lead or mercury. In many applications, one or more LED dies (or chips) are mounted within an LED package or on an LED module, which may make up part of a lighting system, a light fixture, lighting unit, lamp, "light bulb" or more simply a "bulb," which includes one or more power supplies to power the LEDs. An LED fixture may be made in the form of a fixture to be used in place of or instead of a standard incandescent or fluorescent fixture.

Light of varied color hues, or differing correlated color temperature (CCT) can be created by combining LEDs with different emission color points or "color bins." These bins can vary somewhat and be adapted by using firmware to set drive current and therefore brightness. Typically, the lighting system is designed so that each color light source can be managed separately based on the drive current characteristics for that color. The power supply or "driver" is designed to match the configuration of LEDs in the lighting system so that precise control can be accomplished by using separate color control channels. With such an arrangement, a desired CCT can be maintained at any dimming level or user-configurable CCT can be provided. As one example, an LED lamp can be dimmed following the logarithmic profile of color vs. brightness exhibited by incandescent lamps. For some LED lighting products, there is a need to use an independent or pre-existing constant-current driver for the LEDs. With such a driver, the color control described above cannot be accomplished by independently addressing the current supplied by the driver to each color of LED.

SUMMARY

Embodiments of the invention provide a lighting apparatus for use with a constant-current driver in which current diverted from some LEDs to alter the color point of the LEDs is diverted through an shunt path that includes additional LEDs, so that the diverted power still produces light and is not wasted. A signal fed to this shunt path from a controller effectively controls the balance of drive current between two segments of LEDs.

In some embodiments, a lighting system includes a string of LEDs, wherein specific LEDs are operable to emit different colors of light. The string includes a plurality of series-connected color segments. A shunt segment includes additional LEDs. The LED shunt segment is connected in parallel with at least one of the color segments. A controller is connected to the LED shunt segment to selectively balance drive current between the LED shunt segment and the color segment to which it is connected in parallel so that a color temperature of light emitted from the lighting system is controllable by the controller.

In some embodiments, first, second, and third series-connected color segments of series-connected LEDs in a lighting system or solid-state light-emitting apparatus are connectable to a power supply. Each color segment of LEDs operable to emit light of a differing color. A passive shunt circuit is connected in parallel with the first color segment of LEDs and the LED shunt segment comprising LEDs operable to emit light of an additional color is connected in parallel with the second color segment of LEDs. The controller is connected to the passive shunt circuit and the LED shunt segment to independently and selectively divert drive current from the first and second color segments so that a color temperature of light emitted from the apparatus is controllable by the controller. In some embodiments, a plurality of strings of LED devices can be used, wherein at least string one includes multiple color segments.

In any of the embodiments described above, the controller can be responsive to the varying input current and/or voltage of the power supply for the system to alter the drive current through either or both the shunt segment and passive shunt circuit in response to dimming, for example, to achieve so-called "sunset" dimming where the CCT of the lighting system follows the logarithmic profile of color vs. brightness exhibited by incandescent lamps. In some embodiments, the LEDs in the LED shunt segment emit substantially red light. In any of the embodiments, the controller can be responsive instead, or in addition, to user input, which may be provided through an interface specifically used to adjust color temperature.

In any of the embodiments, the color temperature of the system or apparatus can be between 1200K and 3500K. In any embodiment, the color temperature of the system or apparatus can be between 1800K and 3500K. In any embodiment, the color temperature can be reduced from about 3000K to about 2200K during dimming. In some embodiments, the controller is connected to a color segment and a shunt circuit or shunt segment through a transistor, and the controller is operable to control current shunting by applying a pulse-width modulation (PWM) signal to the transistor. The power supply or driver can be included as part of the system or can be connected externally.

In any of the embodiments described above, the first color segment of the lighting system or apparatus can emit substantially red light and the second color segment can emit substantially low blue-shifted yellow (BSY) light. The third color segment can emit light, which can include high BSY light and/or substantially red light. The additional color of the LEDs in the LED shunt segment can be the same or nearly the same as one of the colors used in the color segments, or be different. In any of the embodiments, the LED shunt segment can emit substantially red light or red-orange light.

Embodiments of the invention operate under control of a programmed processor, such as a microprocessor, microcontroller, ASIC, or even a "processor" comprising dedicated circuits, with or without firmware. The color temperature to be emitted by the LED lighting system is determined based on user input, varying input current and/or voltage suggestive of dimming or brightening, or both. The drive current for the string of LEDs configured in one of the ways described above is measured. The processor determines output values for at least some of the plurality of color segments to achieve the color temperature, and outputs a signal to divert drive current from a color segment at least to an LED shunt segment connected in parallel with one of the color segments. This process repeats whenever there is a change in the color temperature needed. In some embodiments the signal is a PWM signal and in some embodiments, current is redirected from one of the color segments to a passive shunt circuit as well as an LED shunt.

The appropriate values for the LEDs in a color segment in any of the above-discussed embodiments can be calculated by evaluating a polynomial equation. Alternatively, these values can be calculated by accessing a look-up table. In any of these embodiments, the processor can constrain output values based on a stored minimum and maximum value. In any of the above-mentioned embodiments, the temperature of the LEDs or elsewhere within a lighting system can be monitored and used in calculating the appropriate output values.

DETAILED DESCRIPTION

Figure 1:
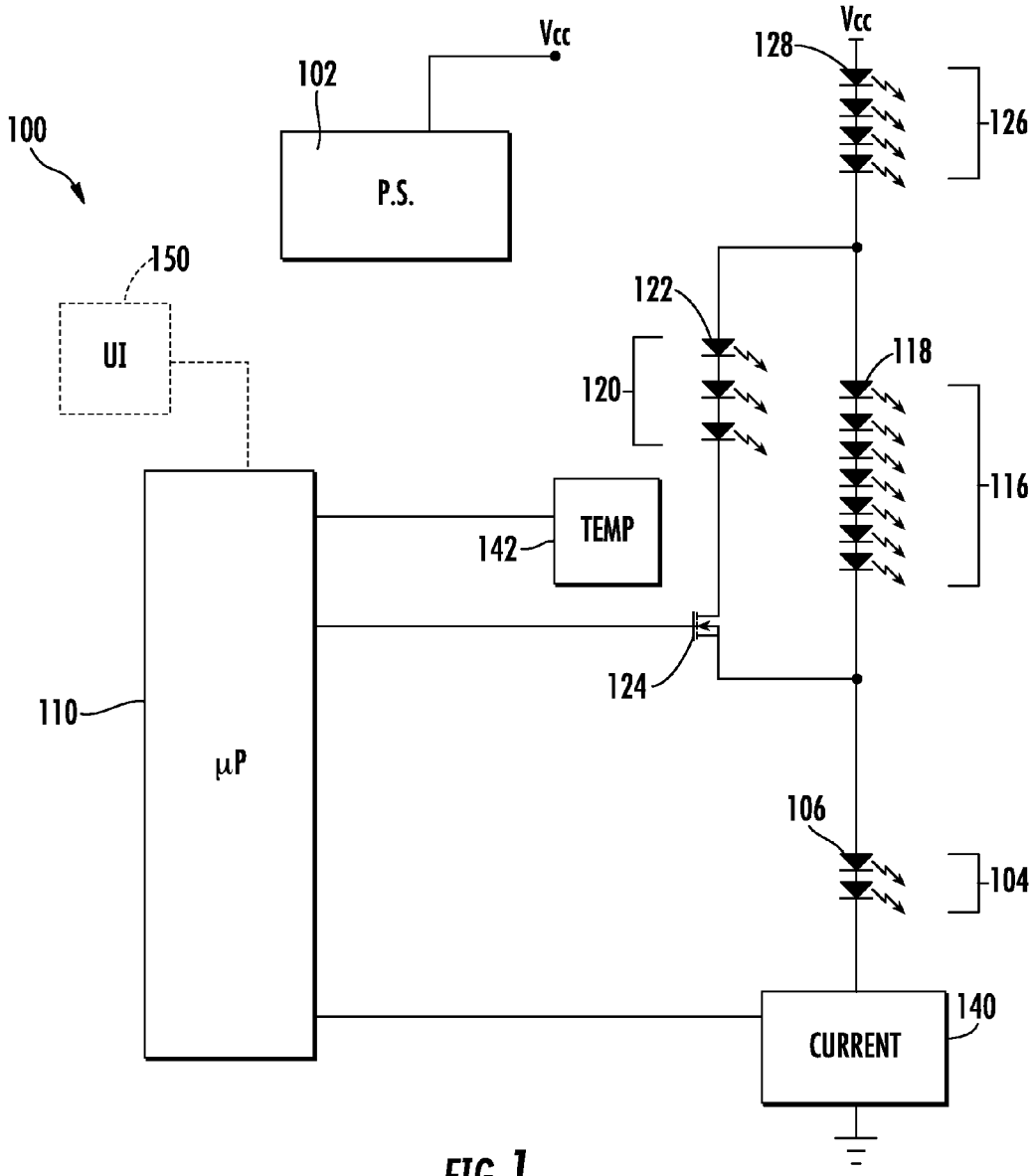
FIG. 1 is a schematic diagram of a lighting system and/or apparatus according to example embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid-state light emitter" or "solid-state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid-state light emitters and/or multiple lumiphoric materials (i.e., in combination with at least one solid-state light emitter) may be used in a single device, such as to produce light perceived as white or near-white in character. If multiple emitters are used in a device, the device may still be referred to as an "LED" or "LED device." In certain embodiments, the aggregated output of multiple solid-state light emitters and/or lumiphoric materials may generate warm white light output having a color temperature range of from about 2700K to about 4000K.

Solid-state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid-state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials may be associated with a lumiphor, a lumiphor binding medium, or a lumiphor support element that may be spatially segregated from a solid-state emitter.

As used herein, the term LED may comprise packaged LED chip(s) or unpackaged LED chip(s). LED elements or modules of the same or different types and/or configurations. The LEDs can comprise single or multiple phosphor-converted white and/or color LEDs, and/or bare LED chip(s) mounted separately or together on a single substrate or package that comprises, for example, at least one phosphor-coated LED chip either alone or in combination with at least one color LED chip, such as a green LED, a yellow LED, a red LED, etc. The LED module can comprise phosphor-converted white or color LED chips and/or bare LED chips of the same or different colors mounted directly on a printed circuit board (e.g., chip on board) and/or packaged phosphor-converted white or color LEDs mounted on the printed circuit board, such as a metal core printed circuit board or FR4 board. In some embodiments, the LEDs can be mounted directly to the heat sink or another type of board or substrate. Depending on the embodiment, the lighting device can employ LED arrangements or lighting arrangements using remote phosphor technology as would be understood by one of ordinary skill in the art, and examples of remote phosphor technology are described in U.S. Pat. No. 7,614,759, assigned to the assignee of the present invention and hereby incorporated by reference.

In those cases where a soft white illumination with improved color rendering is to be produced, each LED element or module or a plurality of such elements or modules may include one or more blue shifted yellow LEDs and one or more red or red/orange LEDs as described in U.S. Pat. No. 7,213,940, assigned to the assignee of the present invention and hereby incorporated by reference. In some embodiments, each LED element or module or a plurality of such elements or modules may include one or more blue LEDs with a yellow or green phosphor and one or more blue LEDs with a red phosphor. The LEDs may be disposed in different configurations and/or layouts as desired, for example utilizing single or multiple strings of LEDs where each string of LEDs comprise LED chips in series and/or parallel. Different color temperatures and appearances could be produced using other LED combinations of single and/or multiple LED chips packaged into discrete packages and/or directly mounted to a printed circuit board as a chip-on board arrangement. In one embodiment, the light source comprises any LED, for example, an XP-Q LED incorporating TrueWhite® LED technology or as disclosed in U.S. Patent Application Publication 2013/0328073, entitled "LED Package with Multiple Element Light Source and Encapsulant Having Planar Surfaces" by Lowes et al., published Dec. 12, 2013, the disclosure of which is hereby incorporated by reference herein, as developed and manufactured by Cree, Inc., the assignee of the present application. If desirable, other LED arrangements are possible. In some embodiments, a string, a group of LEDs or individual LEDs can comprise different lighting characteristics and by independently controlling a string, a group of LEDs or individual LEDs, characteristics of the overall light out output of the device can be controlled.

It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture. The term "LED lighting system" or the term "solid-state lighting system" as used herein can refer to a fixture, an assembly, a light engine, a lamp, a bulb, or any other solid-state lighting arrangement. Mounting arrangement could include a mounting plate with appropriate tabs, holes, or the like to engage with a portion of a pre-existing light fixture.

In example embodiments, three LED color points are mixed to produce white light in an LED arrangement, apparatus, or system. These bins can vary somewhat and be adapted by firmware. Depending on the embodiment, different numbers of color points are possible. The light source is driven by an external constant-current driver, which sets the drive current and therefore overall brightness. The light source is managed by an on-board microprocessor that senses operating conditions and outputs two pulse-width modulation (PWM) signals to control current flow in the LEDs. The light source senses the drive current and can use this information to change correlated color temperature (CCT) according to a dimming profile to accomplish sunset dimming. Alternatively, the CCT can be changed at the command of a user through a user interface to achieve various effects. In such a case, the lighting apparatus receives a separate input of information that indicates what the desired color temperature is and the lighting apparatus can maintain that color temperature at any dimming level.

The same LED arrangement can accomplish any subset, variant, or combination of these color control options—examples include: operating on a reduced range of sunset dimming (e.g. 3000K-2200K); using a combination of color-changing and non-color-changing over dimming (e.g. hold CCT until 50% brightness and then shift warmer below there); dim following the logarithmic profile of color vs. brightness exhibited by incandescent lamps. The control information that instructs the apparatus on what function to perform can be achieved through a variety of methods and/or different types of user interfaces—for example: configuration by jumpers, switches, or an electronic tool on the fixture manufacturer's production line; a 0-10V, DALI, DMX, or other lighting control signal into the light source; a standard or known lighting control signal connected into a constant-current driver, which is then passed on to the lighting apparatus by some other means (I2C, UART, SPI, analog voltage, etc.); a control input by the user that is transmitted to the light source by RF, infrared, etc.

FIG. 1 is a schematic diagram of a lighting system or apparatus, 100, which implements embodiments of the invention. The lighting system or apparatus is driven by constant current power supply (P.S.) 102. It should be noted that other types of power supplies can be used; constant current is not required. However, LED arrangements according to embodiments of the invention can produce a wider range of color outputs than is typically possible with constant current power supplies. The LEDs are connected in a single string with multiple color segments. A segment or multiple segments can be one or two different LEDs and be wavelength converted LEDs with different color temperatures and an additional segment which can be an additional color temperature, such as an RDO or wavelength converted red LED. In the illustrated example, the string is divided into first, second, and third series-connected color segments, one for each color of LED device. First segment 104 in this example includes series-connected, substantially red LEDs 106. As a specific example, these LEDs 106 can be red-orange (RDO) LEDs.

Still referring to FIG. 1, second color segment 116 includes series-connected low blue-shifted-yellow (low BSY) LEDs 118, which are sometimes also termed cool white LEDs. Controller 110 controls the relative amount of light emitted by these LEDs by shunting them through an LED shunt segment 120. In this example embodiment, LED shunt segment 120 includes at least one additional LED. In this example, LED shunt segment 120 includes additional red or RDO LEDs 122. For this second color segment 116, microprocessor 110 selectively balances drive current between the shunt segment 120 and the second color segment 116, to which shunt segment 120 is connected in parallel. Color temperature of light emitted from the lighting system is further controllable by applying a PWM signal to transistor 124 to divert drive current from the second segment into the LED shunt segment as needed to appropriately control the color temperature of light from the apparatus. It would be possible to manage color using a passive shunt circuit. However, an advantage of the LED shunt segment arrangement is that the power diverted from the middle color segment 116 of LEDs is not wasted and still produces light. This significantly increases the efficiency of the overall system, especially at color temperatures below the maximum value. Finally, third color segment 126 includes series-connected LEDs 128 with LEDs that emit both red and high blue-shifted-yellow (high BSY) light. The LEDs 128 in the third color segment 126 are driven by the full amount of current from the power supply 102.

Continuing with FIG. 1, drive current information can be gathered by a current measuring block 140, which is connected to controller 110. Temperature sensor 142 provides temperature information to the controller 110. System 100 also optionally includes user interface (U.I.) 150, which can take any of the forms previously discussed. Otherwise, or in addition, controller 110 can implement color management based on a firmware algorithm to accomplish sunset dimming, or based in part on other sensors that input information to the system. In either case, dimming can be accomplished by diverting and/or altering the drive current through the shunt segment so that the color temperature is reduced or otherwise altered. As an example of an additional sensor, a sensor for ambient light could be used. An external temperature sensor could also be used. By outputting the correct signal to the middle color segment 116 based on drive current information from current measuring block 140, the light source can be made to output a variety of CCTs across the available range or to change color temperature in response to dimming, during which the color temperature can be made to approximate the black-body line about which color bins are organized in a standard color bin chart. Additionally, the microcontroller 110 can measure the temperature of the LEDs and adjust the signal in order to compensate for color shift due to temperature.

In the above-discussed embodiment, the primary task of firmware on the microcontroller is to measure conditions and use the current and temperature information to produce a corresponding PWM output signal. The transfer function between the inputs and outputs is usually referred to as a curve, and may be implemented as a lookup table in the firmware, or as a polynomial equation or equations, depending on the complexity of the curve shape and the memory and speed constraints on the microcontroller. It is also possible to implement this control with discrete circuitry instead of a programmed microprocessor. Depending on the embodiment, other control circuitry can be used using a software-driven controller, firmware, hardware, discrete analog and/or digital devices or any combination thereof. Such circuitry for purposes of this disclosure can also be referred to as a controller.

Figure 2:
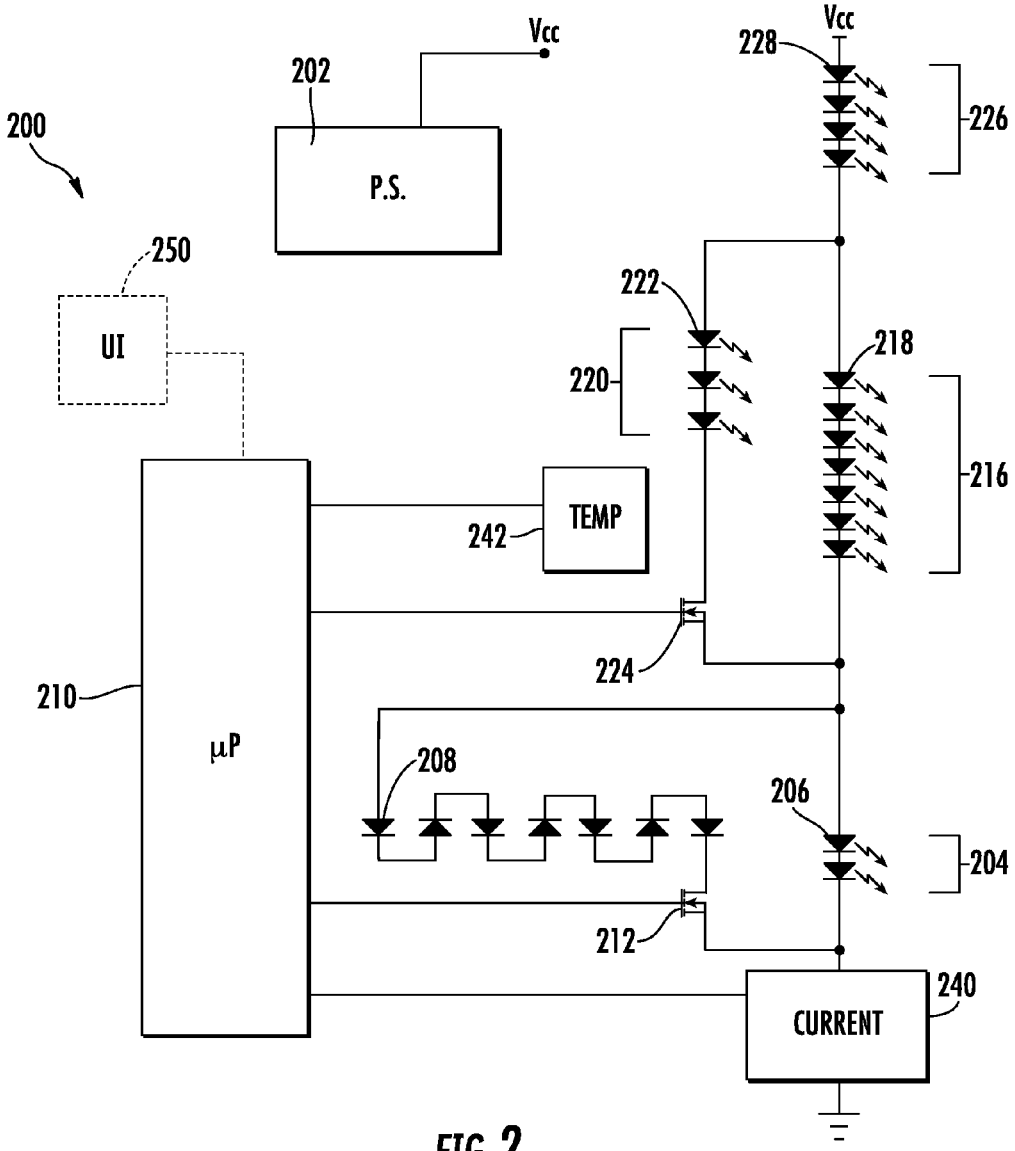
FIG. 2 is a schematic diagram of a lighting system and/or apparatus according to additional example embodiments of the invention.

FIG. 2 is a schematic diagram of a lighting system or apparatus, 200, which implements embodiments of the invention. The lighting system or apparatus is driven by constant current power supply (P.S.) 202. The main LEDs are connected in a single string with multiple color segments. In the illustrated example, the string is divided into first, second, and third series-connected color segments, one for each color of LED device. First segment 204 in this example includes series-connected RDO LEDs 206 and is connected in parallel with a passive shunt circuit including a number if diodes, 208, Zener or otherwise, connected in series. Microprocessor 210 (a microcontroller or controller) applies a pulse-width modulation (PWM) signal to a transistor 212 to divert drive current from the first segment as needed to appropriately control the color temperature of light from the apparatus.

Still referring to FIG. 2, second color segment 216 includes series-connected low blue-shifted-yellow (low BSY) LEDs 218. Controller 210 controls the relative amount of light emitted by these LEDs by shunting them through an LED shunt segment 220. In this example embodiment, LED shunt segment 220 includes at least one additional LED. In this example, LED shunt segment 220 includes additional RDO LEDs 222. For this second color segment 216, microprocessor 210 selectively balances drive current between the shunt segment 220 and the second color segment 216, to which shunt segment 220 is connected in parallel. Color temperature of light emitted from the lighting system is further controllable by applying a PWM signal to transistor 224 in a fashion similar to that already discussed for the passive shunt circuit. Thus, two transistors are used, one connected to the controller for each of the two color segments that can be shunted. For purposes of this disclosure, the transistor connected to the LED shunt segment can be referred to as a first transistor and the transistor connected to the passive shunt circuit can be referred to as a second transistor. It would be possible to manage color using a second passive shunt circuit. However, an advantage of the LED shunt segment arrangement is that the power diverted from the middle color segment 116 of LEDs is not wasted and still produces light. This significantly increases the efficiency of the overall system, especially at color temperatures below the maximum value. Finally, third color segment 226 includes series-connected LEDs 228 with chips that emit both red and high blue-shifted-yellow (high BSY) light. The LEDs 228 in the third color segment 226 are driven by the full amount of current from the power supply 202.

Continuing with FIG. 2, drive current information can be gathered by a current measuring block 240, which is connected to controller 210. Temperature sensor 242 provides temperature information to the controller 210. System 200 also optionally includes user interface (U.I.) 250, which can take any of the forms previously discussed. Otherwise, or in addition, controller 210 can implement color management based on a firmware algorithm to accomplish sunset dimming, or based in part on other sensors that input information to the system. In either case, dimming can be accomplished by diverting and/or altering the drive current through the shunt segment and/or shunt circuit so that the color temperature is reduced or otherwise altered. As an example of an additional sensor, a sensor for ambient light could be used. An external temperature sensor could also be used. By outputting the correct signals to the lower two color segments 204 and 216 based on drive current information from current measuring block 240, the light source can be made to output any CCT across the available range or to change color temperature in response to dimming, during which the color temperature can be made to follow the black-body line about which color bins are organized in a standard color bin chart. Additionally, the microcontroller 210 can measure the temperature of the LEDs and adjust the signal to the red segment 204 in order to compensate for color shift due to temperature.

Figure 3:
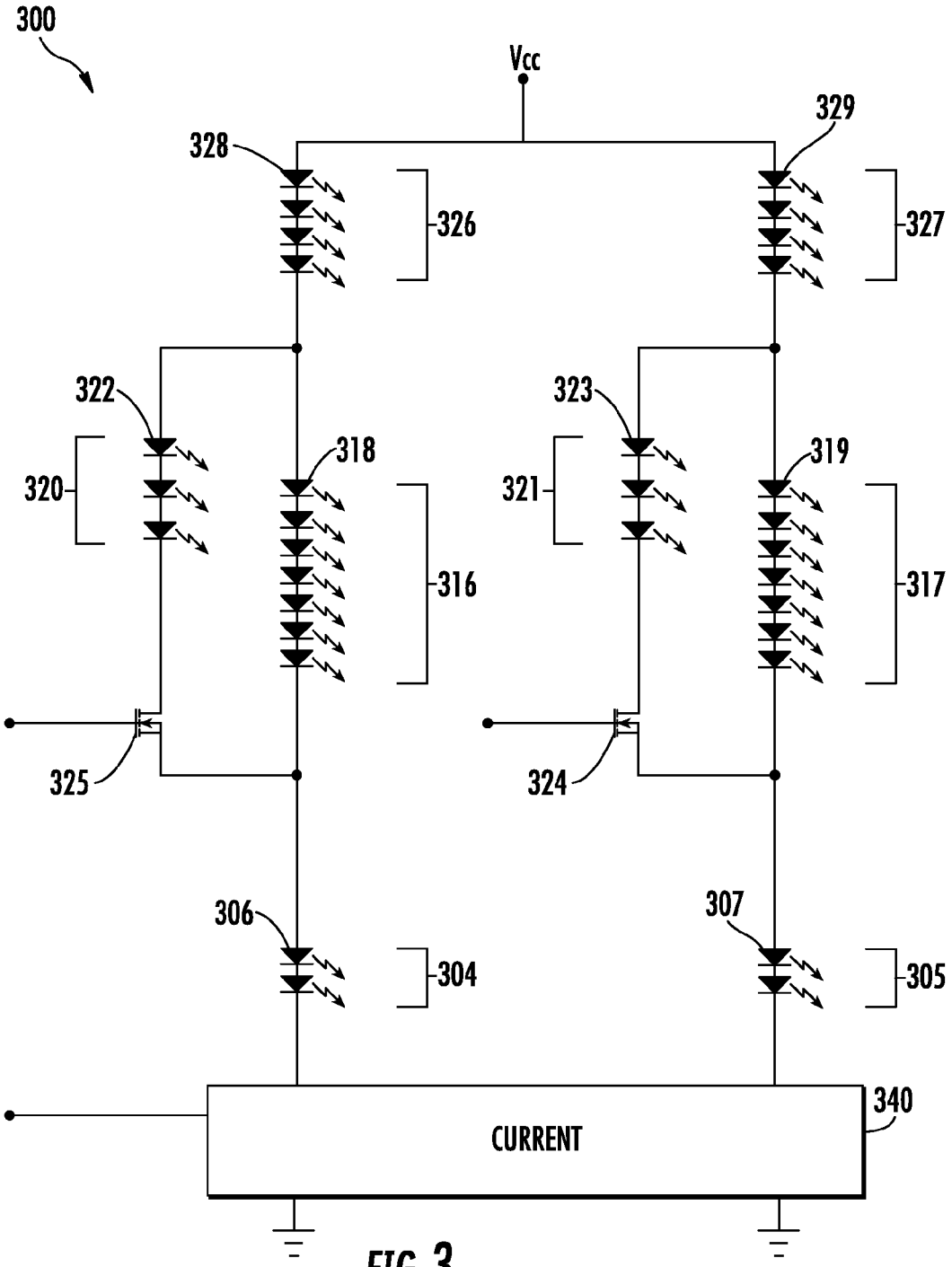
FIG. 3 is a schematic diagram of a lighting system and/or apparatus according to further example embodiments of the invention.

FIG. 3 is a schematic diagram of a lighting system or apparatus, 300, which implements embodiments of the invention. In this particular embodiment, system 300 includes a plurality of strings of LED devices, wherein at least one includes multiple color segments as previously described. In this example, two strings are shown and each includes multiple color segments, however, any number of strings can be used and the strings can have the same or differing configurations of LEDs. Control circuitry, sensors, and user interface hardware are omitted for clarity, but connections to the controller are shown. The main LEDs are connected in two parallel strings, each with multiple color segments. In the illustrated example, each string is divided into first, second, and third series-connected color segments, one for each color of LED device. First segment 304 of the first string (pictured on the left in FIG. 3) in this example includes series-connected RDO LEDs 306.

Still referring to FIG. 3, second color segment 316 of the first string includes series-connected low BSY LEDs 318. The controller controls the relative amount of light emitted by these LEDs by shunting them through an LED shunt segment 320. In this example embodiment, LED shunt segment 320 connected to the first string includes at least one additional LED. In this example, LED shunt segment 320 includes additional RDO LEDs 322. For this second color segment 316 of the first LED string, the processor selectively balances drive current between the shunt segment 320 and the second color segment 316, to which shunt segment 320 is connected in parallel. Color temperature of light emitted from the lighting system is further controllable by applying a PWM signal to transistor 325. Third color segment 326 of the first LED string includes series-connected LEDs 328 with chips that emit both red and high BSY light.

Continuing with FIG. 3, drive current information for both LED strings can be gathered by a current measuring block 340, which is connected to the controller. The second LED string (pictured on the right in FIG. 3) includes first segment 305, which in this example includes series-connected RDO LEDs 307. Second color segment 317 of the second string includes series-connected low BSY LEDs 319. The controller controls the relative amount of light emitted by these LEDs by shunting them through an LED shunt segment 321. In this example, LED shunt segment 321 includes additional RDO LEDs 323. For this second color segment 317 of the second LED string, the processor selectively balances drive current between the shunt segment 321 and the second color segment 317, to which shunt segment 321 is connected in parallel. Color temperature of light emitted from the lighting system is further controllable by applying a PWM signal to transistor 324. Third color segment 327 of the second LED string includes series-connected LEDs 329 with chips that emit both red and high BSY light.

Figure 4:
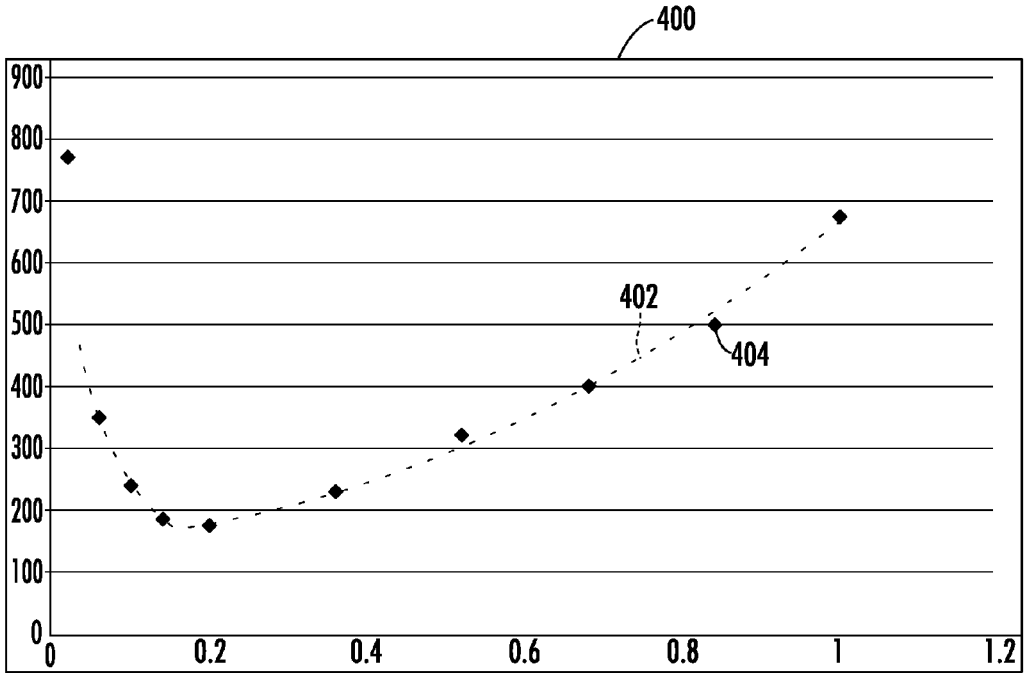
FIG. 4 is a color curve that corresponds to a polynomial equation or a look-up table used to determine appropriate output values for LEDs according to example embodiments of the invention.

FIG. 4 is a graph 400 illustrating a color curve 402 like that described above. The curve can be created by fitting sample points 404. For this example, a curve for red LEDs is shown. To design a system, a simulation can be run to select appropriate LEDs for the color segments of an LED system like that described with reference to FIG. 2. A light bulb or fixture with the LED lighting apparatus can be placed in an integrating sphere and precise color measurements can be made while the PWM signals are varied in order to derive the transfer function curve more precisely. For curve 402 in FIG. 4, the vertical axis is labeled with a PWM count based on a 10-bit PWM signal, which has a maximum count of 1024. The horizontal axis represents input current in Amps. Curve 402 is actually represented by two polynomial equations, the first one shown below for the portion of the curve 402 to the left of the break point and the second one shown below for the portion of the curve 402 to the right of the break point.

$$\text{output}=44.41i-0.731$$

$$\text{output}=446.428751i^2+69.642857i+147.5$$

As should be apparent to those who program microprocessors, calculating values using the above equations directly requires floating point mathematics, which is computationally expensive. The output can be instead calculated using bitwise shifts, as shown below.

$$\text{output}=44.41i-0.731$$

$$\text{output}=446.428751i^2+69.642857i+147.5$$

$$\text{output}=1421*i>>5-1$$

$$\text{output}=3571*i^2>>3+557*i>>3+148$$

As an alternative to implementing equations like those shown above, a look-up table can be stored in the processor to enable determination and/or calculation of output values for the LEDs. The table below can be used for the red LEDs in lieu of the equations shown.

| Current | PWM count |
|---|---|
| 0.850 | 664 |
| 0.833 | 644 |
| 0.816 | 626 |
| 0.799 | 607 |
| 0.782 | 589 |
| 0.765 | 572 |
| 0.748 | 554 |
| 0.731 | 538 |
| 0.714 | 521 |
| 0.697 | 505 |
| 0.680 | 489 |
| 0.663 | 473 |
| 0.646 | 458 |
| 0.629 | 443 |
| 0.612 | 429 |
| 0.595 | 415 |
| 0.578 | 401 |
| 0.561 | 388 |
| 0.544 | 375 |
| 0.527 | 362 |
| 0.510 | 350 |
| 0.493 | 338 |
| 0.476 | 326 |
| 0.459 | 315 |
| 0.442 | 304 |

-continued

| Current | PWM count |
|---|---|
| 0.425 | 294 |
| 0.408 | 284 |
| 0.391 | 274 |
| 0.374 | 265 |
| 0.357 | 255 |
| 0.340 | 247 |
| 0.323 | 238 |
| 0.306 | 230 |
| 0.289 | 223 |
| 0.272 | 215 |
| 0.255 | 209 |
| 0.238 | 202 |
| 0.221 | 196 |
| 0.204 | 190 |
| 0.187 | 184 |
| 0.170 | 179 |
| 0.153 | 174 |
| 0.136 | 170 |
| 0.119 | 187 |
| 0.102 | 209 |
| 0.085 | 239 |
| 0.068 | 281 |
| 0.051 | 347 |
| 0.034 | 467 |
| 0.017 | 775 |

In some embodiments, a general-purpose processor such as a digital signal processor, microcontroller, or microprocessor (μP) is used and non-transitory firmware, software, or microcode can be stored in a tangible storage medium that is within or associated with the system or apparatus. Such a medium may be a memory integrated into the processor, or may be a memory chip that is addressed by the processor to perform control functions. Such firmware, software or microcode is executable by the processor and when executed, causes the microcontroller unit to perform its control functions. Such firmware or software could also be stored in or on a tangible medium such as an optical disk or traditional removable or fixed magnetic medium such as a disk drive used to load the firmware or software into a an apparatus or system for maintenance, update, manufacturing, or other purposes. The firmware causes the processor to control an LED lighting apparatus or system to operate according to one of the embodiments described.

Any of the embodiments disclosed herein may include power or driver circuitry having a buck regulator, a boost regulator, a buck-boost regulator, a fly-back converter, a SEPIC power supply or the like and/or multiple stage power converter employing the like, and may comprise a driver circuit as disclosed in U.S. patent application publication 2015/0312983, entitled "High Efficiency Driver Circuit with Fast Response" by Hu et al., published Oct. 29, 2015, or U.S. Pat. No. 9,303,823, issued Apr. 5, 2016, entitled "SEPIC Driver Circuit with Low Input Current Ripple" by Hu et al. incorporated by reference herein. The circuit may further be used with light control circuitry that controls color temperature of any of the embodiments disclosed herein, such as disclosed in U.S. patent application publication 2015/0351187, entitled "Lighting Fixture Providing Variable CCT" by Pope et al., published Dec. 3, 2015, incorporated by reference herein. Additionally, any of the embodiments described herein can include driver circuitry disclosed in U.S. patent application Ser. No. 15/018,375, titled "Solid State Light Fixtures Having Ultra-Low Dimming Capabilities and Related Driver Circuits and Methods," filed Feb. 8, 2016 and assigned to the same assignee as the present application, the entirety of this application being incorporated herein by reference.

Figure 5:
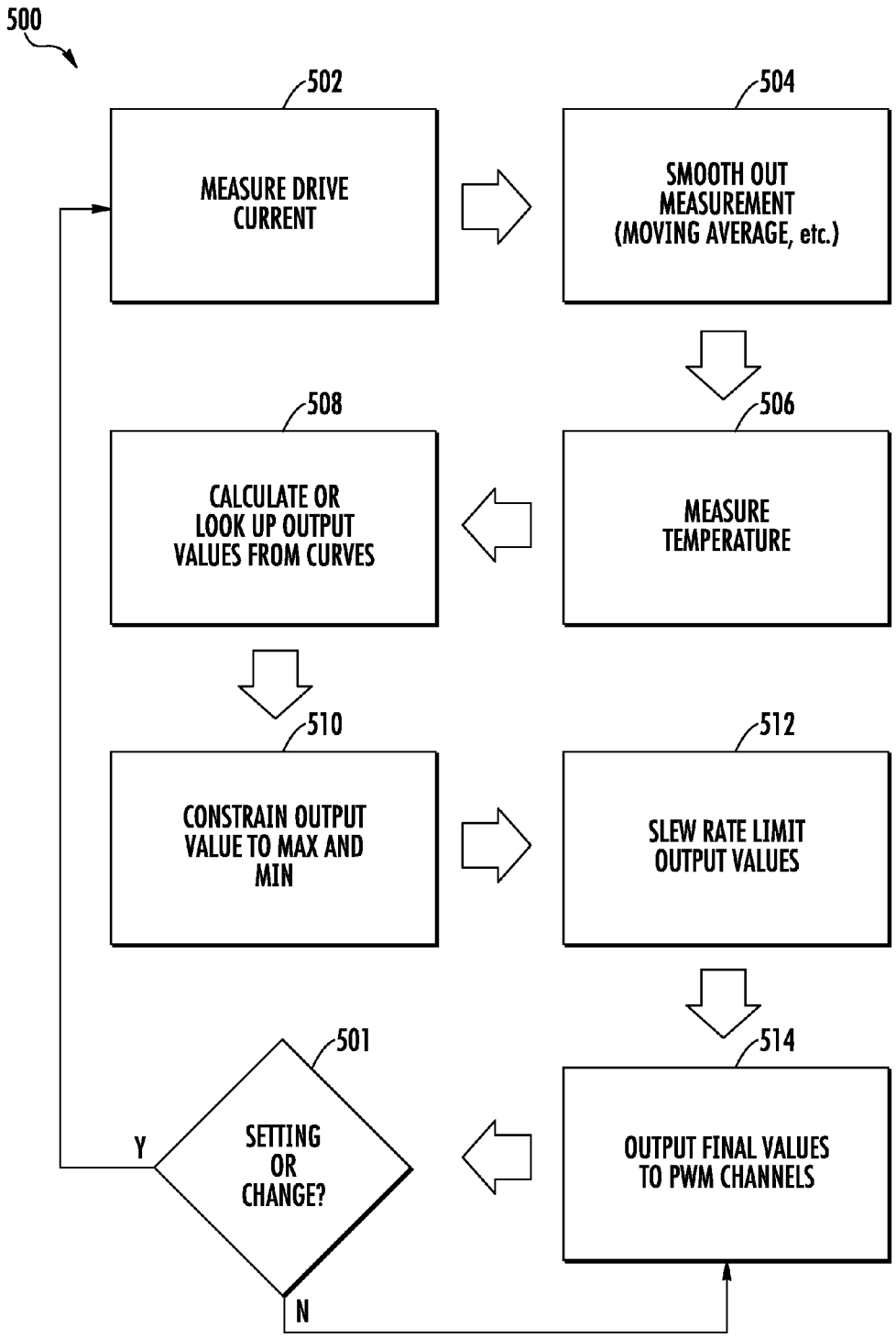
FIG. 5 is a flowchart illustrating operation of a lighting system according to example embodiments of the invention.

FIG. 5 is a flowchart illustrating the operation of a system like that shown in FIG. 2. Like most flowcharts, FIG. 5 illustrates a method of setting color temperature as a series of process or subprocess blocks. In some embodiments process 500 in FIG. 5 is a continuous process. In other embodiments, the process is performed periodically or in response to a particular event or action. At block 501, a determination of the color temperature to be emitted by the LED lighting system is made, initially, and any time there is a change. This determination can be based on user input, varying input current and/or voltage for a power supply indicating dimming by reduction or brightening by increase, or both. At block 502, the drive current for the string of LEDs with a plurality series-connected color segments of series-connected LEDs is measured. At block 504, the measurement is smoothed out, that is some averaging and/or other processing is carried out to account for sampling points, constant sampling rate if used, and the like to ensure the measured drive current value accurately reflects the actual drive current for the LEDs. At block 506 the temperature is measured to determine if and how the temperature will change the color output of the LEDs. At block 508, the output values for the color segments and/or LEDs are calculated or looked up by the processor. If the equations are used, the processor determines the output value by evaluating the appropriate equation for each point on a color curve. Otherwise values are accessed from a stored table. Either of these operations can be referred to "calculating" or as a "calculation" performed by a processor. At block 510, the output values are optionally filtered by the processor to constrain the output values based on a stored minimum and maximum value.

Still referring to FIG. 5, slew rate limits are applied to the output values at block 512. These rate limits are developed and applied based on aesthetics. Too sudden of a change in color temperature from an LED lighting system can seem abrupt and be displeasing to the eye. Finally at block 514, the processor outputs a pulse-width modulation (PWM) signal to divert drive current from the color segments at least to an LED shunt segment comprising LEDs operable to emit light of an additional color. Another PWM signal may also be used to divert current to a passive shunt circuit for another color segment of the LED string. The system then returns to monitoring mode at block 501.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. For example, embodiments are described as having a single string with multiple color segments. A single string or segment can include LEDs, strings or segments of LEDs that are in a serial/parallel arrangement. Additionally, embodiments of the present invention can use multiple strings where at least one string comprises a single string with multiple color segments and the other strings have the same or different structures. In some embodiments, there can be multiple strings wherein each string comprises multiple color segments. Additionally and depending on the embodiments, the LEDs can be the same strings. Alternatively, additional strings can be used in parallel. The following claims are in no way intended to limit the scope of the invention to the specific embodiments described herein.

The invention claimed is:

1. A lighting system comprising:

a string of LEDs, wherein specific LEDs are operable to emit different colors of light, the string further comprising a plurality of series-connected color segments;

a shunt segment connected in parallel with at least one of the color segments, the shunt segment further comprising at least one additional LED; and a controller connected to the shunt segment to selectively balance drive current between the shunt segment and the color segment to which the shunt segment is connected in parallel so that a color temperature of light emitted from the lighting system is controllable by the controller.

2. The lighting system of claim 1 wherein the string of LEDs is connectable to a power supply with varying input current and/or voltage, wherein the controller is responsive to the varying input current and/or voltage to alter the drive current through the shunt segment.

3. The lighting system of claim 1 wherein the controller is responsive to user input.

4. The lighting system of claim 2 wherein the color temperature is between 1200K and 3500K and is reduced at least in part by altering the drive current through the shunt segment when the lighting system is dimmed by reduction of the input current and/or voltage.

5. The lighting system of claim 4 wherein the color temperature is between 1800K and 3500K.

6. The lighting system of claim 4 wherein the color temperature is reduced from about 3000K to about 2200K.

7. The lighting system of claim 1 wherein the string of LEDs further comprises a plurality of strings of LEDs, at least one of the plurality of strings of LEDs comprising the plurality of series-connected color segments.

8. The lighting system of claim 4 further comprising a transistor connected between the controller and at least one color segment.

9. The lighting system of claim 8 wherein the controller connected to the transistor to supply a pulse-width modulation (PWM) signal to the transistor.

10. The lighting system of claim 9 further comprising the power supply connected to the string of LEDs.

11. A lighting system comprising:

a string of LEDs, wherein specific LEDs are operable to emit different colors of light, the string further comprising a plurality of series-connected color segments;

a passive shunt circuit connected in parallel with a first color segment from among the plurality of series-connected color segments;

an LED shunt segment connected in parallel with a second color segment from among the plurality of series-connected color segments; and a controller connected to the passive shunt circuit and the LED shunt segment to selectively balance drive current between the passive shunt circuit and/or the LED shunt segment, and the first and/or second color segments, so that a color temperature of light emitted from the lighting system is controllable by the controller.

12. The lighting system of claim 11 wherein the string of LEDs is connectable to a power supply with varying input current and/or voltage, wherein the controller is responsive to the varying input current and/or voltage.

13. The lighting system of claim 11 wherein the controller is responsive to user input.

14. The lighting system of claim 12 wherein the color temperature is between 1200K and 3500K and is reduced at least in part by altering the drive current through the passive shunt circuit and/or the LED shunt segment when the lighting system is dimmed by reduction of the input current and/or voltage.

15. The lighting system of claim 14 wherein the color temperature is between 1800K and 3500K.

16. The lighting system of claim 14 wherein the color temperature is reduced from about 3000K to about 2200K.

17. The lighting system of claim 11 wherein the string of LEDs further comprises a plurality of strings of LEDs, at least one of the plurality of strings of LEDs comprising the plurality of series-connected color segments.

18. The lighting system of claim 11 further comprising at least two transistors including a transistor connected between the controller and each of the first and second color segments.

19. The lighting system of claim 18 wherein the controller is operable to supply a pulse-width modulation (PWM) signal to each of the at least two transistors.

20. The lighting system of claim 19 further comprising the power supply connected to the string of LEDs.

21. A solid-state light-emitting apparatus comprising:

first, second, and third series-connected color segments of series-connected LEDs connectable to a power supply, each color segment of LEDs operable to emit light of a differing color;

a passive shunt circuit connected in parallel with the first color segment of LEDs;

an LED shunt segment comprising LEDs operable to emit light of an additional color, the LED shunt segment connected in parallel with the second color segment of LEDs; and a controller connected to the passive shunt circuit and the LED shunt segment to independently and selectively divert drive current from the first and second color segments so that a color temperature of light emitted from the apparatus is controllable by the controller.

22. The apparatus of claim 21 wherein the controller is responsive to user input, varying input current and/or voltage for the power supply, or both.

23. The apparatus of claim 22 wherein the LED shunt segment emits substantially red light.

24. The apparatus of claim 23 wherein the color temperature is between 1200K and 3500K and is reduced at least in part by diverting the drive current through the LED shunt segment in accordance with reduction of the input current and/or voltage.

25. The apparatus of claim 24 wherein the color temperature is reduced from about 3000K to about 2200K.

26. The apparatus of claim 22 wherein the first color segment emits substantially red light and second color segment emits substantially low blue-shifted yellow (BSY) light.

27. The apparatus of claim 26 further comprising:

a first transistor connected between the passive shunt circuit and the controller; and a second transistor connected between the LED shunt segment and the controller.

28. The apparatus of claim 27 wherein the controller is operable to supply pulse width modulation (PWM) signals to the first transistor and the second transistor.

29. A method of setting a color temperature for an LED lighting system, the method comprising:

determining the color temperature to be emitted by the LED lighting system based on user input, varying input current and/or voltage for a power supply, or both;

measuring a drive current for a string of LEDs comprising a plurality series-connected color segments of series-connected LEDs;

calculating, using a processor, output values for at least some of the plurality of color segments to achieve the color temperature;

outputting by the processor a pulse-width modulation (PWM) signal to divert drive current from the color segments at least to an LED shunt segment comprising LEDs operable to emit light of an additional color, the LED shunt segment connected in parallel with one of the color segments; and repeating the above in response to a change in the drive current and in response to user input, input current and/or voltage for the power supply, or both.

30. The method of claim 29 wherein the outputting of the PWM signal further comprises outputting PWM signals to a passive shunt circuit and the LED shunt segment to independently and selectively divert drive current from two color segments.

31. The method of claim 30 wherein the calculating of the output values further comprises evaluating a polynomial equation.

32. The method of claim 30 wherein the calculating of the output values further comprises accessing a look-up table.

33. The method of claim 32 further comprising constraining by the processor of the output values based on a stored minimum and maximum value.

34. The method of claim 33 further comprising measuring a temperature within the LED lighting system and calculating the output values in part based on the temperature.

* * * * *